US009138903B2

(12) United States Patent
Vellekamp

(10) Patent No.: US 9,138,903 B2
(45) Date of Patent: Sep. 22, 2015

(54) KICKER ASSIST MECHANISM

(75) Inventor: Isaac Vellekamp, Puyallup, WA (US)

(73) Assignee: Blade-Tech Industries, Inc., Puyallup, WA (US)

( * ) Notice: Subject to any disclaimer, the term of this patent is extended or adjusted under 35 U.S.C. 154(b) by 475 days.

(21) Appl. No.: 13/351,494

(22) Filed: Jan. 17, 2012

(65) Prior Publication Data

US 2012/0180319 A1 Jul. 19, 2012

(51) Int. Cl.
*B26B 1/04* (2006.01)
*B26B 1/02* (2006.01)

(52) U.S. Cl.
CPC ..... *B26B 1/02* (2013.01)

(58) Field of Classification Search
CPC ..... B26B 1/02; B26B 1/04; B26B 1/042; B26B 1/044; B26B 1/046; B26B 1/048
USPC ..... 30/151–161
See application file for complete search history.

(56) References Cited

U.S. PATENT DOCUMENTS

| | | | | | |
|---|---|---|---|---|---|
| 249,896 | A * | 11/1881 | Chamberlain | 30/155 |
| 412,799 | A * | 10/1889 | Schenck | 30/158 |
| 689,513 | A * | 12/1901 | Papendell | 30/158 |
| 698,080 | A * | 4/1902 | Treas | 30/159 |
| 1,022,494 | A * | 4/1912 | Minter | 30/158 |
| 2,416,277 | A * | 2/1947 | Siegel | 30/158 |
| 4,974,323 | A * | 12/1990 | Cassady | 30/155 |
| 5,331,741 | A * | 7/1994 | Taylor, Jr. | 30/158 |
| 5,685,079 | A * | 11/1997 | Brothers et al. | 30/161 |
| 5,896,665 | A * | 4/1999 | Harris | 30/160 |
| 6,918,184 | B2 * | 7/2005 | Glesser | 30/161 |
| 7,107,685 | B1 * | 9/2006 | Anderson | 30/158 |
| 7,533,465 | B1 * | 5/2009 | Frazer | 30/155 |
| 8,375,589 | B2 * | 2/2013 | Bremer et al. | 30/155 |
| 2006/0272158 | A1 | 12/2006 | Williams | |
| 2009/0183374 | A1 * | 7/2009 | Kao | 30/159 |
| 2009/0293286 | A1 * | 12/2009 | Williams | 30/158 |
| 2010/0218383 | A1 * | 9/2010 | Williams | 30/158 |
| 2012/0159789 | A9 * | 6/2012 | Frazer | 30/159 |
| 2012/0198701 | A1 * | 8/2012 | Lo | 30/161 |

FOREIGN PATENT DOCUMENTS

| | | | |
|---|---|---|---|
| JP | 07-328244 | * 12/1995 | B26B 1/02 |

* cited by examiner

*Primary Examiner* — Laura M Lee
(74) *Attorney, Agent, or Firm* — Wolfe-SBMC

(57) ABSTRACT

Techniques involving a kicker assist mechanism and other functionality are described. In one or more implementations, the techniques describe a device that includes a lever coupled to a stop-pin and configured to cause deployment of a blade from a handle of a folding knife. The lever may be configured to pivot about the stop-pin in response to a push or pull force directed at one end of the lever and engage the blade with an opposing end of the lever with a force to cause the deployment of the blade. The blade may be configured to deploy in a pivotal movement from a closed position of the folding knife to a deployed position in response to the force employed by the opposing end of the lever.

6 Claims, 4 Drawing Sheets

KICKER ASSIST MECHANISM

CROSS REFERENCE TO RELATED APPLICATIONS

This application claims priority under 35 U.S.C. 119(e) to U.S. Provisional Patent Application No. 61/433,435 which was filed on Jan. 17, 2011, and titled "Kicker Assist Mechanism," the disclosure of which is hereby incorporated by reference in its entirety.

BACKGROUND

Users may utilize folding knives for a variety of different activities. For safety purposes, these folding knives are foldable to cover up a sharp cutting edge of a blade by enclosing the sharp cutting edge within a handle of the folding knife. As a result, users may carry these folding knives with a reduced risk of being cut or stabbed by the blade.

When a user wishes to use the blade of the folding knife, the user may deploy the blade so that the sharp cutting edge of the blade is accessible. However, traditional techniques for deploying the blade of the folding knife to expose the sharp cutting edge of the blade may be difficult for users who lack sufficient dexterity and/or strength to perform the traditional techniques, which can lead to user frustration. In addition, these traditional techniques for deploying the blade of the folding knife may pose a risk to the user of being cut or stabbed upon deployment of the blade. Therefore, the deployment of the blade of a folding knife can be dangerous, inefficient, and may result in user frustration and/or harm.

SUMMARY

Kicker assist mechanism techniques are described. In one or more implementations, a device comprises a lever coupled to a stop-pin and configured to cause deployment of a blade from a handle of a folding knife. The lever may be configured to pivot about the stop-pin in response to a push or pull force directed at one end of the lever and engage the blade with an opposing end of the lever with a force to cause the deployment of the blade. The device also comprises the blade, which is configured to deploy in a pivotal movement from a closed position of the folding knife to a deployed position in response to the force employed by the opposing end of the lever.

In one or more implementations, a method includes causing a lever to pivotally move about a stop-pin in response to a push/pull force applied to one end of the lever, where the lever is configured to contact a blade of a folding knife, and engaging the blade on the folding knife with an opposing end of the lever to cause the blade to deploy from a closed position of the folding knife to an open position of the folding knife in response to the push/pull force on the one end of the lever.

In one or more implementations, a folding knife comprises a blade, a handle pivotally connected to the blade and configured to house at least an edge of the blade in a folded position of the folding knife, and a lever pivotally connected to a stop-pin and comprising first and second opposing ends. The first opposing end may be configured to receive a push/pull force to cause pivotal movement of the lever about the stop-pin, and the second opposing end may be configured to engage the blade in response to the push/pull force received at the first opposing end and cause the blade to deploy from the folded position of the folding knife.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Overview

Knives may be made foldable to protect a user from accidentally being cut or stabbed by the blade. However, traditional techniques for deploying the blade of a folding knife to expose the sharp cutting edge of the blade may pose a risk to the user of being harmed by the blade. In addition, these traditional techniques can be difficult for a user who lacks sufficient dexterity and/or strength to perform the traditional techniques, thereby resulting in user frustration.

Kicker assist mechanism techniques are described. In an implementation, a kicker assist mechanism may comprise a lever that is configured to pivot about a stop-pin of a folding knife to assist in deployment of a blade. The lever may include the stop-pin or may be configured to couple to the stop-pin for pivotal movement. In addition, the lever may comprise opposing ends, one end configured to force the blade out of a handle of the folding knife by at least pushing the blade in response to a push/pull force acting on the opposing end of the lever. For example, when a user pushes or pulls on one end of the lever, the lever is configured to pivot on the stop-pin and engage the blade with the opposing end of the lever so as to force the blade out of the handle. The blade may be configured to be coupled at one end of the blade to one end of the handle and deployed when the lever causes pivotal movement of the blade at the connected ends. A variety of different configurations are contemplated to deploy the blade, further discussion of which may be found in relation to FIGS. 1-3.

Figure 1:
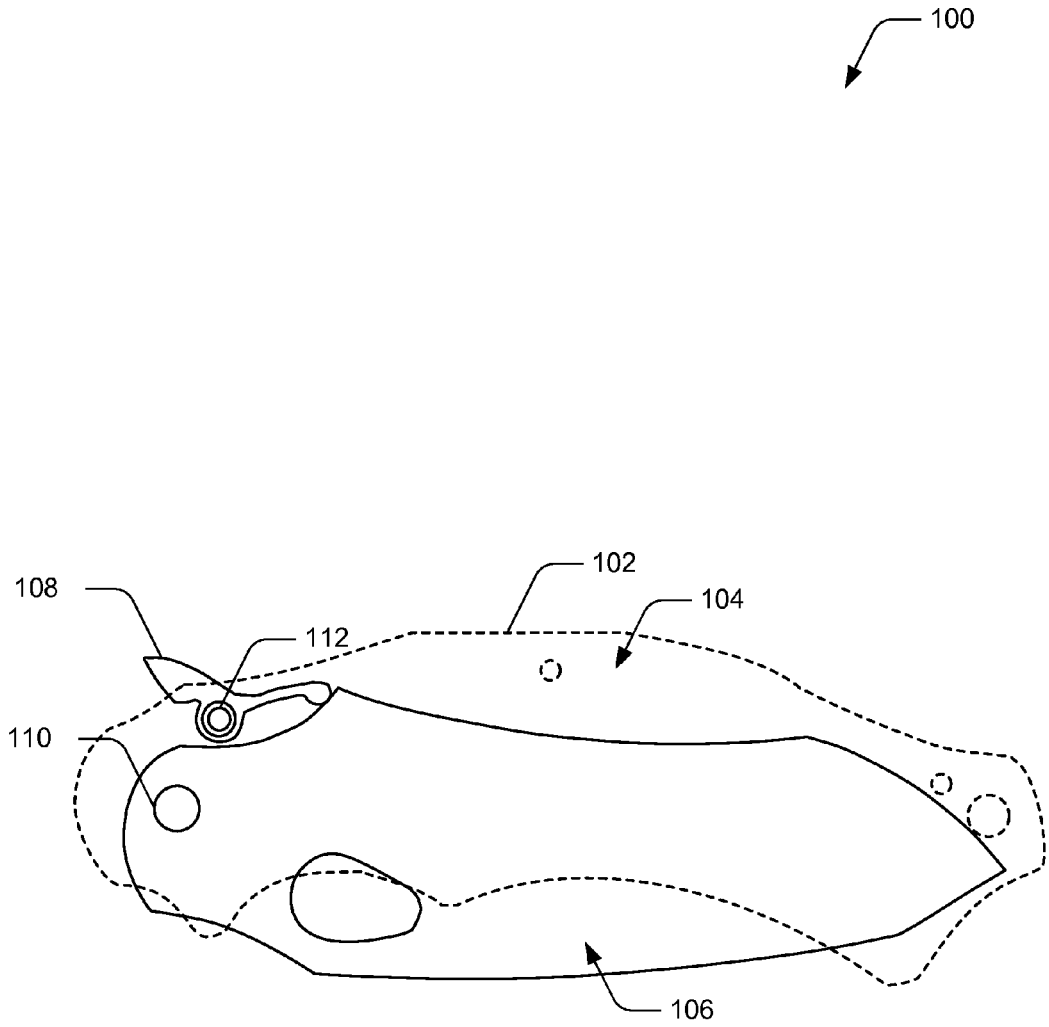
FIG. 1 is an illustration of an example implementation of a kicker assist mechanism implemented in a folding knife in a closed position.

FIG. 1 illustrates an example implementation 100 of a folding knife 102 in a folded or closed position. The folding knife 102 includes a handle 104 (shown as a dotted line in FIG. 1), a blade 106, and a lever 108. The blade 106 in this case may be disposed between two sides of the handle 104 and may pivotally move about a pivot point 110 when the blade 106 is deployed from the folded position of the folding knife to a deployed position, or when the blade 106 is pivotally moved to the folded position of the folding knife from the deployed position.

In addition, the lever 108 may pivot on a stop-pin 112 and engage the blade with one end of the lever 108. The lever 108 in this case includes an opposing end that may extend outward from the handle when the folding knife 102 is in the folded position of the folding knife. The lever 108 may be configured to force the blade 106 out of the handle 104 of the folding knife 102 in response to a force acting upon the end of the lever 108 that extends outward from the handle 104. For example, a user may grip the handle 104 and push or pull the extended end of the lever 108. By doing so, the lever 108 may pivot about the stop-pin 112 and the opposing end of the lever 108 may engage the blade 106 as a result of the push or pull force at the extended end of the lever 108.

The extended end of the lever 108 may include a planar surface that is usable by a user to apply a push or pull force with the user's thumb or finger. The planar surface of the extended end of lever 108 may be smooth to reduce harm to the user, or alternatively, rough to increase friction between the extended end of the lever 108 and the user's finger for better control of the lever 108. The opposing end of the lever 108 which engages the blade 106 may include a cam-shape at the end of a cantilever arm. In this example, the cam-shaped end may engage the concave edge of the blade 106, and as the blade 106 deploys, the cam-shaped end slides along the concave edge of the blade 106.

In addition, the extended end of the lever 108 and the opposing end that engages the blade 106 may be coaxial, parallel, or perpendicular with one another. Alternatively, the opposing ends of the lever 108 may be positioned relative to one another at an acute or obtuse angle. In addition, the opposing ends may be connected at a vertex used to pivot about the stop-pin 112. Additionally, the length of each end of the lever 108 may be configured so as to reduce the push or pull force required to deploy the blade 106. For instance, one end of the lever 108 may be longer than the opposing end, or alternatively, the opposing ends of the lever 108 may have similar lengths.

Figure 2:
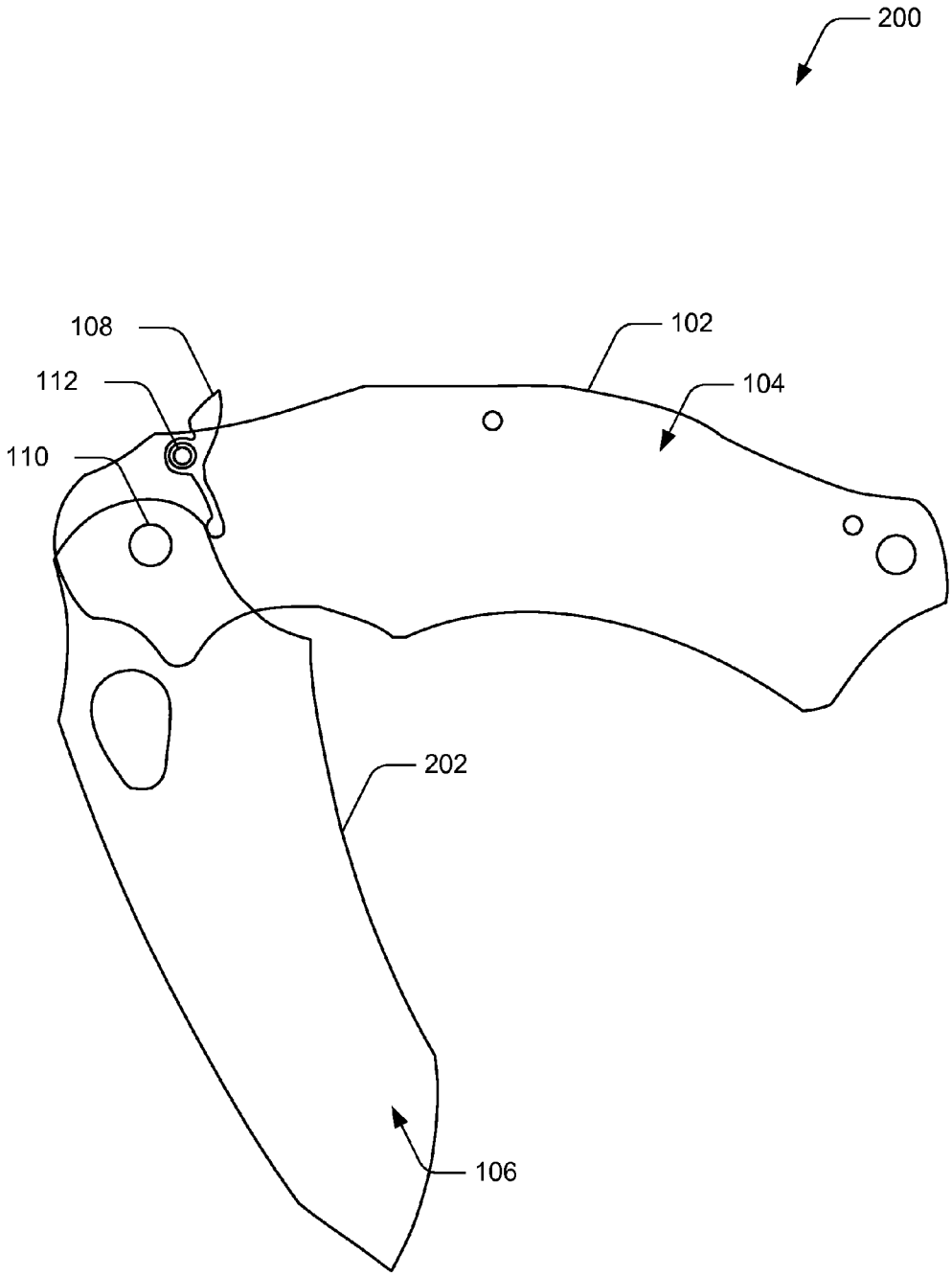
FIG. 2 is an example implementation of a kicker assist mechanism implemented in a folding knife in an open position.

An example implementation 200 of a deployment of the blade 106 is shown in FIG. 2. For example, as the push or pull force is applied to the extended end of the lever 108, the opposing end of the lever 108 may apply a force on the blade 106 to cause the blade 106 to pivotally move about the pivot point 110 so as to expose a sharp cutting edge 202 of the blade 106. The user may stop applying the push or pull force at the extended end of the lever 108 once the blade 106 is deployed to the user's desired position.

Figure 3:
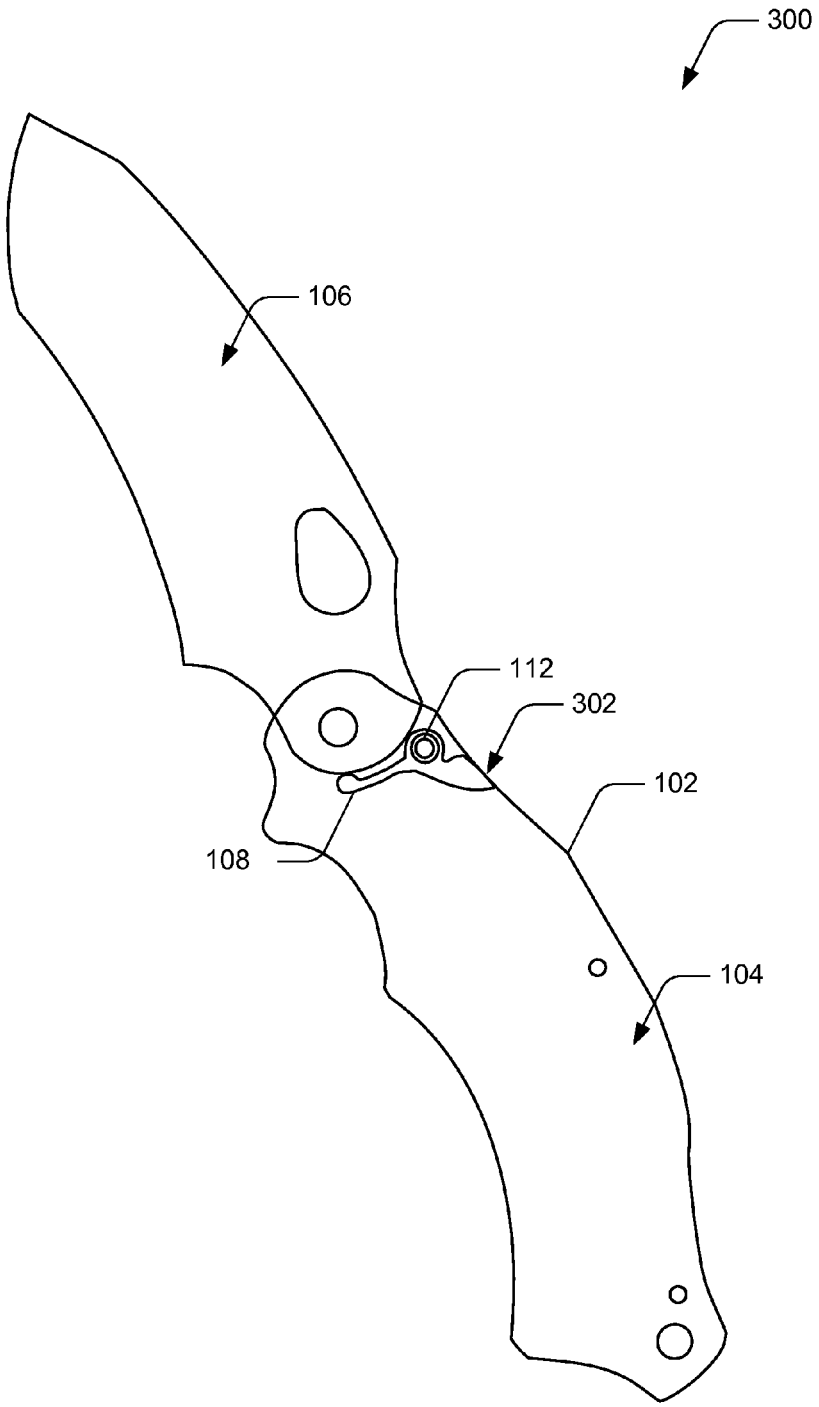
FIG. 3 is an example implementation of a kicker assist mechanism implemented in a folding knife in a fully opened position.

FIG. 3 shows an implementation 300 of the folding knife 102 in a fully opened position such that the blade 106 is fully deployed. In an implementation, once the blade 106 is fully deployed, the lever 108 may be positioned such that the lever 108 does not protrude from the handle 104, as shown at 302 in FIG. 3. Instead, the lever 108 may rest within the handle 104, or between two opposing sides of the handle 104, to allow a user to comfortably grip the handle 104 and avoid being stabbed by the lever 108.

A variety of configurations are contemplated for securing the lever 108 in a desired position after the blade 106 has been deployed. For example, some embodiments may use a spring, magnet, or cam-based system to secure the lever 108 in the desired position. In addition, the lever 108 may be formed from a variety of materials and/or compositions (e.g., metal plastic, carbon fiber, fiberglass, and so on, or any combination thereof). Additionally, the lever 108 may be located in front of, or behind the stop-pin 112. Alternatively, the lever 108 may comprise the stop-pin 112, or may act as the stop-pin 112. Also, the lever 108 may be configured to pivot on a separate pin for function, safety, and/or manufacturing purposes. In addition, the lever 108 may be separate from the blade 106 such that when the blade 106 is fully deployed, the blade 106 is free of appendages used for deployment of the blade.

Example Procedures

Figure 4:
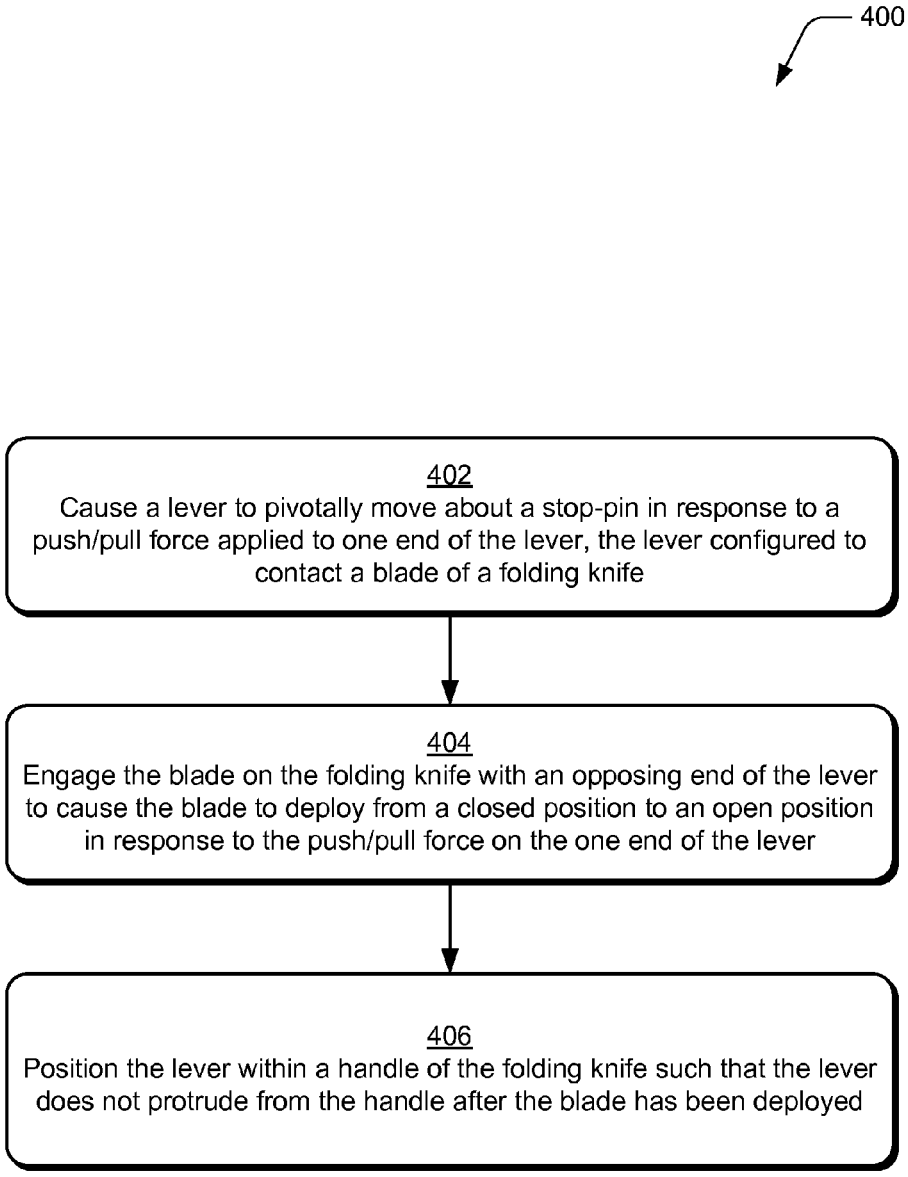
FIG. 4 is a flow diagram depicting a procedure in an example implementation of a kicker assist mechanism in which a lever is used to deploy a blade from a folding knife.

FIG. 4 is a flow diagram that depicts a procedure 400 in an example implementation of a kicker assist mechanism in which a lever is used to deploy a blade of a folding knife. The procedure is shown as a set of blocks in this example that specify operations and are not necessarily limited to the orders shown for performing the operations by the respective blocks. In portions of the following discussion, reference may be made to the example implementations 100, 200, and 300 of FIGS. 1-3, respectively.

A lever is caused to pivotally move about a stop-pin in response to a push/pull force applied to one end of the lever (block 402). For example, when a user wishes to deploy a blade 106 of a folding knife 102 from a closed position of the folding knife where the sharp cutting edge 202 of the blade 106 is disposed within the handle 104, the user may apply a push force or a pull force to an extended end of the lever 108 that extends outward from the handle 104. When the push/pull force is applied, the lever 108 may pivotally move about the stop-pin 112 and contact the blade 106.

The blade of the folding knife is engaged with an opposing end of the lever to cause the blade to deploy from a closed position of the folding knife to an open position of the folding knife in response to the push/pull force on the one end of the lever (block 404). For example, as the push/pull force is applied to the extended end of the lever 108 that extends outward from the handle 104, the lever 108 is forced to pivot about the stop-pin and cause the opposing end of the lever 108 to apply a force to the blade 106. The force applied to the blade 106 by the opposing end of the lever 108 causes the blade 106 to pivotally move about the pivot point 110. The pivot point 110 connects the blade 106 to the handle 104. As the blade 106 pivotally moves about the pivot point 110, the blade 106 is deployed and the sharp cutting edge 202 of the blade 106 is exposed. The user may cease application of the push/pull force once the blade 106 is deployed to the desired position, such as partial or full deployment.

The lever is positioned within the handle of the folding knife such that the lever does not protrude from the handle after the blade has been deployed (block 406). For example, once the blade 106 has been full deployed, the end of the lever 108 that previously extended outward from the handle 104 when the folding knife 102 was in the closed position no longer extends outward from the handle 104 when the folding knife 102 is in a fully opened position. Instead, the end of the lever 108 is positioned within the handle 104, or between two opposing sides of the handle 104, due to its pivotal movement caused by the push/pull force. By positioning the end of the lever 108 within the handle 104, the user may comfortably grip the handle with a reduced risk of being stabbed by the lever 108.

Conclusion

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A folding knife, comprising:

a blade;

a handle pivotally connected to the blade and configured to house at least an edge of the blade in a folded position of the folding knife; and a lever configured to be planar with the blade and pivotally connected to a stop-pin, the lever comprising first and second opposing ends, the first opposing end configured to extend outward from the handle when the blade is in the folded position and receive a push/pull force to cause pivotal movement of the lever about the stop-pin, the second opposing end configured to engage the blade in response to the push/pull force received at the first opposing end and cause the blade to deploy from the folded position of the folding knife, the first opposing end configured to be positioned within the handle such that the lever does not protrude from the handle when the blade is in a fully deployed position.

2. The folding knife of claim 1, wherein the stop-pin is positioned proximal a pivotal connection of the blade and the handle.

3. The folding knife of claim 1, wherein the lever is separate from the blade.

4. The folding knife of claim 1, wherein the lever is separate from the stop-pin.

5. The folding knife of claim 1, wherein the first and second opposing ends of the lever extend outward from a pivot point.

6. The folding knife of claim 1, wherein the second opposing end of the lever is configured to engage a concave portion of an edge of the blade.

* * * * *